US007094264B2

(12) United States Patent
Steer

(10) Patent No.: US 7,094,264 B2
(45) Date of Patent: Aug. 22, 2006

(54) APPARATUS FOR OBTAINING COMBUSTION GASES OF HIGH CALORIFIC VALUE

(76) Inventor: Thomas Steer, Jahnstrasse 8, 85356 Freising (DE)

( * ) Notice: Subject to any disclaimer, the term of this patent is extended or adjusted under 35 U.S.C. 154(b) by 90 days.

(21) Appl. No.: 11/060,322

(22) Filed: Feb. 18, 2005

(65) Prior Publication Data

US 2005/0166457 A1 Aug. 4, 2005

Related U.S. Application Data

(63) Continuation of application No. PCT/EP00/09767, filed on Oct. 5, 2000, and a continuation of application No. 10/116,038, filed on Apr. 5, 2002, now abandoned.

(30) Foreign Application Priority Data

Oct. 7, 1999 (DE) ..... 199 48 332

(51) Int. Cl.
*C01B 3/32* (2006.01)

(52) U.S. Cl. ..... 48/198.7; 422/139

(58) Field of Classification Search ..... 48/61, 48/62 R, 71–73, 78, 89, 98–101, 105, 102 A, 48/111, 119, 120, 123, 200–202, 209–210, 48/197 FM, 198.7; 422/139, 141, 144–147, 422/184.1, 185, 188, 223, 200–201, 204–205, 422/232–236

See application file for complete search history.

(56) References Cited

U.S. PATENT DOCUMENTS

| | | | | |
|---|---|---|---|---|
| 3,754,993 | A * | 8/1973 | Oguchi et al. | 134/25.1 |
| 4,249,472 | A * | 2/1981 | Mitchell | 110/245 |
| 4,515,659 | A * | 5/1985 | Wingfield et al. | 201/2.5 |
| 4,541,841 | A * | 9/1985 | Reinhardt | 48/197 R |
| 5,059,404 | A * | 10/1991 | Mansour et al. | 423/201 |
| 5,634,950 | A * | 6/1997 | McIlroy et al. | 48/111 |

* cited by examiner

*Primary Examiner*—Glenn Caidarola
*Assistant Examiner*—Tom P. Duong
(74) *Attorney, Agent, or Firm*—Lawrence E. Laubscher, Sr.; Lawrence e. Laubscher, Jr.

(57) ABSTRACT

The present invention relates to a method for obtaining combustion gases of high calorific value, wherein carbonaceous materials are allothermically gasified in a fluidized layer containing solid particles, using a gaseous gasifying agent and by supply of heat, and the gases thus produced are separated from the solid particles and withdrawn. Said method is characterized in that the solid particles are indirectly heated in a first descending bed and supplied to a second ascending fluidized bed in which the fluidized layer is formed and gasification takes place for the greatest part. The method further relates to an apparatus for performing said method.

17 Claims, 2 Drawing Sheets

APPARATUS FOR OBTAINING COMBUSTION GASES OF HIGH CALORIFIC VALUE

REFERENCE TO RELATED APPLICATION

This application is a continuation application of PCT International Application No. PCT/EP00/09767 filed Oct. 5, 2000, which is based on the German Application No. 199 48 332.9 filed Oct. 7, 1999. It is also a continuation of U.S. application Ser. No. 10/116,038 filed Apr. 5, 2002, now abandoned.

BACKGROUND OF The INVENTION

Field of the Invention

The present invention relates to a method for obtaining combustion gases of high calorific value and to an apparatus for performing the method.

Careful use of resources becomes more and more the central objective of society. Energy generation from waste materials and regenerative substances such as biogenic fuels during first or consecutive use is thus of special importance. Furthermore, towards the end of the $20^{th}$ century the generation of hydrogen becomes more and more the center of interest, not least due to the beginning exploitation of hydrogen in fuel cells.

The energetic exploitation of solid, paste-like or liquid fuels is most of the time carried out by way of combustion with subsequent use of the previously chemically bound heat released during combustion.

Apart from this, there have been approaches for a long time to establish gasification processes for generating combustion gases of high calorific value from solid, paste-like or liquid fuels. The combustible part of the crude gas during each gasification consists for the greatest part of hydrogen and carbon monoxide; smaller amounts are methane and higher hydrocarbons. Each type of gasification thus generates hydrogen.

An essential advantage of gasification over combustion is that the pollutants contained in the starting substance are converted in a reducing atmosphere into constituents or nto relatively simple chemical compounds. The gas volumes are considerably smaller in comparison with combustion, so that gas purification in the case of gasification can be carried out more easily and at lower costs as compared to combustion when the objective is the same.

There are three basic types of gasification methods:

1. Gasification of solid, paste-like or liquid fuels with the gasification medium air is in technical terms the simplest method and leads to partial oxidation. The calorific value of the gas produced thereby is lower than that of the fuel used. The gasification temperatures are typically within the range of 600° C. to 900° C. Tars are produced at said temperatures to a considerable extent. A large-scale use of the method has so far not been possible because so far the removal of tars from the gas could not be sufficiently controlled technically for small gasifiers.

2. Like air gasification, the gasification of solid, paste-like or liquid fuels with the gasification medium oxygen results in partial oxidation with a decrease in the calorific value. The gasification temperatures are typically at 1600° C. so that the formation of tar is ruled out. A large-scale use has so far not been possible because the generation of the necessary oxygen entails high costs and excessively burdens economic calculations in industry. In comparison with air gasification, oxygen gasification leads to smaller gas amounts because the gasification medium does not introduce an inert nitrogen amount.

3. The gasification of solid, paste-like or liquid fuels with the gasification medium steam leads to a gas of a higher calorific value than the fuel used originally. Therefore, heat must be supplied to the gasification reactor from the outside. The gasification temperatures are typically between 600° and 900° C. Tar might be formed. However, its potential is lower than in air gasification. A large-scale use has so far not been possible because the problem of heat input into the reactor has, in particular, not been solved in a satisfactory way. The gas amounts of the steam gasification lie between those of air and oxygen gasification. This is due to the fact that during steam gasification the carbon if the fuel is oxidized by the oxygen of the steam into carbon monoxide or carbon dioxide, whereby additional hydrogen is formed. The potential of the steam gasification to generate hydrogen is thus considerably higher than that of air or oxygen gasification.

Gasification methods in which the reaction heat needed is supplied by partial oxidation are called autothermic, whereas those in which the reaction heat needed is supplied from the outside are called allothermic.

The allothermic steam gasification of solid, paste-like or liquid fuels normally takes place in a fluidized bed for ensuring uniform reaction conditions. In this process, steam flows from below to a bed of small solid particles. The inflow rate is here so high that the solid particles are at least kept suspended. One talks about a stationary fluidized bed when the solid particles form a fixedly defined surface with ascending gas bubbles, whereas in a circulating fluidized bed the main part of the solid particles is discharged with the gas flow from the fluidized bed reactor and is separated from the gas flow and then supplied again via a down path to the lower part of the fluidized bed reactor proper. The solid particles may be inert, consisting e.g. of quartz sand, limestone, dolomite, corundium, or the like, but they may also consist of the ash of the fuel. The solid particles can accelerate the gasification reactions due to catalytic properties.

Description of the Related Art

The Nack, et al., U.S. Pat. No. 4,154,581 describes a gas generator comprising two reaction zones and having an exothermic reaction environment in the heating portion, so that heat is directly provided, Heat transportation is ensured by using bed material of different grain sizes. A coarse grained material remains in the exothermic bed, whereas a fine-grained fraction travels from the exothermic into the endothermic region and back. The fine-grained fraction assumes the function of heat transfer.

Said method has the drawback that the transportation of the solids between the beds must coincide with the heat balance of the beds, which makes great demands on the control units at high working temperatures and different load conditions. Furthermore, as far as the fuels are concerned, there is no separation between the combustion region and the gasification region, so that possible pollutants from the fuel may be found along both the gasification path and the combustion path, which complicates the gas cleaning system.

It is known from EP 0 329 673 and the Mansour, et al., U.S. Pat. No. 5,059,404 that heat input is realized with the help of heat exchangers which are provided in the fluidized bed, i.e. in the reaction zone. The drawback of such a concept is that the arrangement of the heat exchangers in the reaction zone predetermines the dimension of the reaction zone and the fluidized bed, respectively, because of the heat exchange surfaces required. Moreover, the heat exchange surfaces are directly exposed to the corrosive effects of harmful constituents of the fuel, which makes extreme demands on the material at surface temperatures of from 600° C. to more than 900° C.

Finally, a combination of autothermic and allothermic methods is known from DE 197 36 867 A1. The necessary reaction heat is here supplied via hot steam and flue gases from a partial combustion of the product gas.

The combination of an autothermic and allothermic method has the effect that the gas amount increases considerably due to the nitrogen amount which is supplied with the air for partial combustion. Thus the partial pressures of the industrial gases decrease, which has a negative effect on the subsequent gas cleaning and the aftertreatment of the gas.

A fluidized bed constitutes a technology which has been tried and tested and often employed for many years. Applications are e.g. the drying and burning of solid materials or of slurries. The basis for each fluidized bed method is a reactor in which a solids content is loosened by inflow from below to such an extent that the individual particles start to float in air, with the solids content being fluidized.

A distinction is made between two coarse types: When a solid surface of the fluidized solids content is formed, one talks about a stationary fluidized bed. When the particles are discharged with the gas flow from the reactor, one talks about a circulating fluidized bed. Further essential features of every circulating fluidized bed are an apparatus for separating the discharged solid particles from the gas flow and a further means for returning the separated solid particles into the reactor.

In the course of time many constructional forms have been used for both basic types in the attempt to avoid the drawbacks of the one type and to exploit the benefits of the other.

The following documents should be mentioned by way of example:

- DE 28 36 531: A stationary fluidized bed method in which regions of different fluidization are formed by installing a partition, so that bed material is circulated in a stationary bed.
- EP 0 302 849: A circulating fluidized bed which develops DE 28 36 531, but rather reminds of a stationary than a circulating fluidized bed because of its constructional size.
- DE 33 20 049: A stationary fluidized bed method in which bed material is circulated due to different bed heights.

Summary of the Invention

It is an object of the present invention to indicate a method and an apparatus for obtaining combustion gases of high calorific value for eliminating the above-mentioned problems at least in part.

Advantageously, there is no heating means in the reaction chamber in the method according to the invention and in the apparatus according to the invention. Corrosion problems that have so far existed are thereby avoided. Moreover, the inventive method and the inventive apparatus are not limited to special heating means, but permit the use of any desired heating means, in particular tubular heat exchangers. Advantageously, no fuel particles pass from the reducing zone into an oxidizing zone. Moreover, the reaction chamber can be designed independently of the geometrical dimensions predetermined for the heating means, so that the constructional size of the apparatus according to the invention can be optimized.

In a preferred embodiment of the method of the invention, the first descending bed is loosened or slightly fluidized by injecting a gas; advantageously, this prevents an undesired agglomeration of the solid particles and is conducive to the transportation of the bed material. In another embodiment, the first descending bed is indirectly heated with the help of a heat exchanger which has a heating medium flowing therethrough. The heating medium may here flow in pulsating fashion in the heat exchanger upon heat emission to the first descending bed. Heat transfer from the heat exchanger to the first descending bed is thereby improved.

Furthermore, gasification may take place under pressure or under atmospheric conditions. The carbonaceous materials may consist of liquid, paste-like or solid materials, in particular of coke, crude oil, biomass or waste materials. Thus, the method according to the invention advantageously permits the processing of the most different carbonaceous materials. In a further preferred embodiment of the method according to the invention, steam is used as the gasifying agent.

In a preferred first embodiment of the apparatus according to the invention, the heating zone and the reaction zone may be separated by way of different fluidization of the fluidized bed, the different fluidization effecting a circulation of the bed material about one or several substantially horizontal axes. The substantially horizontal axes may be closed in the form of a ring. Said embodiment of the apparatus according to the invention is particularly characterized by a compact construction. In a second embodiment of the apparatus according to the invention, the heating zone and the reaction zone are separated by a wall. Moreover, the heating zone and the reaction zone may each be formed in a separate reactor. These two embodiments offer the advantage of a reliable separation of the heating zone from the reaction zone by constructional measures. The means for transferring the heated solid particles may be a wall opening or a pipe. Furthermore, said means for transferring the heated solid particles may be provided in a lower region of the heating zone. In a preferred embodiment, said means comprises a nozzle bottom with the help of which the solid particles can be slightly fluidized in the heating zone.

In a preferred embodiment of the apparatus according to the invention, the indirect heat supply means is at least one heat exchanger through which a heating medium can flow and which is provided in or at the heating zone. The use of heat exchangers as heat supply means simplifies the construction of the reactor. Moreover, the heat exchanger may comprise at least one resonant tube in which the heating medium flows in pulsating fashion upon heat emission to the heating zone. Advantageously, the heat transfer from the heat exchanger to the heating zone is thereby improved. The resonant tube may be connected to a combustion chamber for resonance generation. The generation of the desired resonance may also be achieved with the help of an acoustic resonator which is arranged such that it is separated from the combustion chamber.

In another embodiment, the means for producing the ascending fluidized bed is a nozzle bottom provided in a lower portion of the reaction zone. Such a nozzle bottom offers the advantage of a uniform injection of the fluidizing medium into the reaction zone.

The means for separating the gases produced during gasification from the solid particles may be a cyclone. In another preferred embodiment the separating means comprises baffles for producing a sharp deflection of the gas flow, whereby the gas flow and the solid particle flow are separated; the baffles are here followed by a channel for gas discharge and by the heating zone. Furthermore, a means for transferring the solid particles from the reaction zone into the heating zone may be provided for circulating the solid particles. Said means may be a wall opening or a pipe. Preferably, said means is provided in an upper portion of the reaction zone.

The supply region for carbonaceous materials may terminate in the heating zone. Moreover, a supply means for the carbonaceous materials may also terminate in the reaction zone.

The invention shall now be explained in more detail with reference to embodiments taken in conjunction with the drawing, in which:

DETAILED DESCRIPTION

Figure 1:
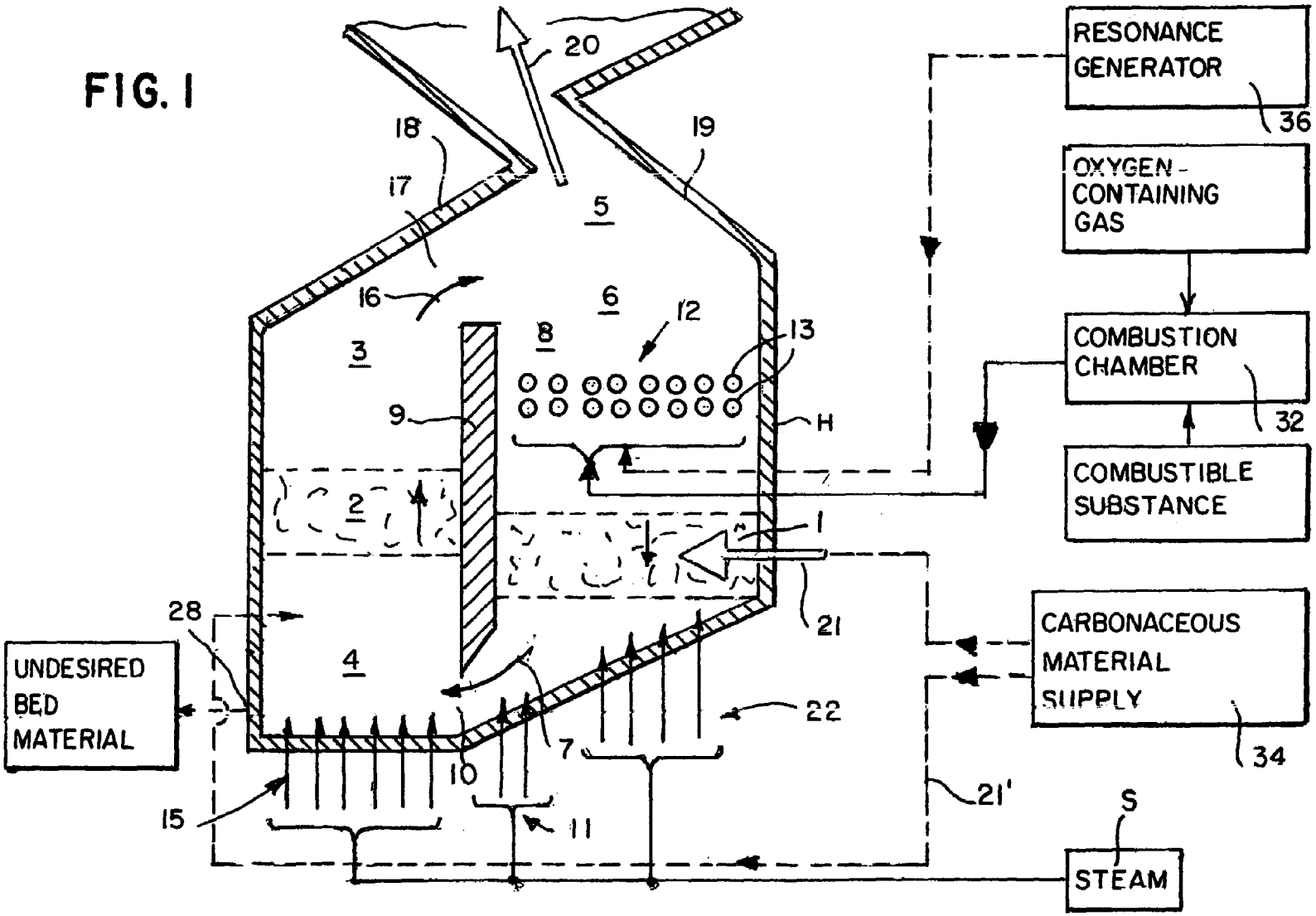
FIG. 1 is a cross section through an embodiment of the apparatus of the invention, where the means for separating the gases from the solid particles comprises baffles.

The embodiment of the apparatus of the invention as shown in FIG. 1 comprises a housing H having a chamber containing a reaction zone 3 in which carbonaceous materials are gasified. The carbonaceous materials are positioned in an ascending fluidized bed 2 which is produced with the help of fluidizing means 4 in the reaction zone 3. The fluidizing means 4 provided in the lower area of the reaction zone 3 may, e.g., be an open or closed first nozzle bottom 15 through which the fluidizing medium steam S is blown into the zone. The steam may be mixed with gases. The nozzle bottom 15 defines the reaction zone 3 in which the fluidized bed 2 is formed. Next to or below the nozzle bottom 15, there is provided an outlet 28 from which, e.g., bed material, undesired materials arising from the fuel, ash and non-reacted fuel components can be withdrawn. Steam may be injected into the outlet, said steam facilitating a withdrawal on the one hand and ensuring a post-reaction of remaining constituents of the fuel on the other hand. Furthermore, the illustrated embodiment comprises a heating zone 6 which is separated from the reaction zone 3 by a separating device 9. During operation of the reactor, a descending bed 1 of solid particles is formed in the heating zone 6. The lower portion of the heating zone 6 may have disposed therein a second nozzle bottom 22 for the inflow of steam, the steam loosening or slightly fluidizing the bed material of the heating zone for improving transportation of the material. Arranged above the heating zone 6 is the separating and discharging means 5, as will be described in greater detail below.

As shown in FIG. 1, a means 8 for indirectly supplying heat is arranged in the heating zone 6. Said heat supply means 8 may e.g. be composed of one or several heat exchangers. It is clear that the present invention is not limited to the special arrangement of the heat exchanger 12 shown in FIG. 1, but other arrangements are also possible, e.g. on the wall of the heating zone 6. Moreover, instead of the illustrated tubular heat exchanger 12, a planar heat exchanger may be used that is e.g. integrated into the wall of the heating zone 6.

The heat exchanger 12 provided in the heating zone may partly consist of resonant tubes 13 in which the heating medium flows in pulsating fashion into the heating zone 6 upon heat emission. The resonant tubes 13 are connected to a combustion chamber 32 or, as shown by the phantom line, to another resonance generator 36 for generating the resonant oscillation. The heating medium is directly heated by combustion of a combustible substance with oxygen-containing gas.

As can be seer in FIG. 1, the solid particles are thus heated separately with respect to the gasification taking place in the reaction chamber 3. Due to the weak fluidization of the heating zone, a slowly descending bed 1 is formed in said zone, whereas due to the strong fluidization of the reaction zone 3 a rapidly ascending fluidized bed 2 is formed in said zone. The arrangement of the heat exchanger 12 in the slowly descending bed 1 reduces the great mechanical wear of the heat exchanger that has so far been observed in the prior art. Moreover, the heat exchanger 12 in the heating zone is subjected to less corrosive effects than in the reaction zone 6. This means that the reactor has a longer service life.

The heating zone 6 is connected to the reaction zone 3 via a first transfer passage means 7 with the help of which the solid particles heated in the heating zone 6 are transferred into the reaction zone 3. As shown in FIG. 1, said means 7 is shaped as a wall opening or passage 10. Said means 7, however, may3 e.g.3 also be designed as a pipe. For promoting the transportation of the heated solid particles from the heating zone 6 into the reaction zone 3, the first transfer passage means 7 for transferring the heated solid particles may comprise a third nozzle bottom 11. With the help of said third nozzle bottom 11 it is possible to loosen or slightly fluidize the solid particles. The first nozzle bottom 15 used for producing the ascending fluidized bed 2 may be used as the third nozzle bottom 11. Attention must here be paid that the fluidizing action is more pronounced in the reaction zone 3 than in the heating zone 6.

For circulating the solid particles, a second transfer passage means 16 is provided in the upper area of the reaction zone 3 for returning the solid particles from the reaction zone 3 into the heating zone 6. As shown in FIG. 1, said means 16 may be a wall opening 17. It is also possible to design said second transfer passage means 16 as a pipe. The separating and discharging means 5 for separating the gases produced during gasification from the solid particles and for discharging said gases are baffles 18 and 19 in the embodiment shown in FIG. 1. The baffles 18 and 19 effect a strong deflection of the flow which cannot be followed by the solid particles. Gas flow and solid particle flow are thus separated at the baffles. The gas flow is discharged via the gas path 20 by which the baffles 18 and 19 are separated. The solid particle flow showers into the heating zone 6 positioned below the baffles 18 and 19.

In the embodiment shown in FIG. 1, a feed means 21 for carbonaceous materials from the supply 34 thereof terminates in the heating zone 6. The fuel can either be pressed into said zone in the area of bed 1 or discharged from above onto bed 1. Moreover, it is possible to provide a further feed means 21' which terminates in the reaction zone 3.

Figure 2:
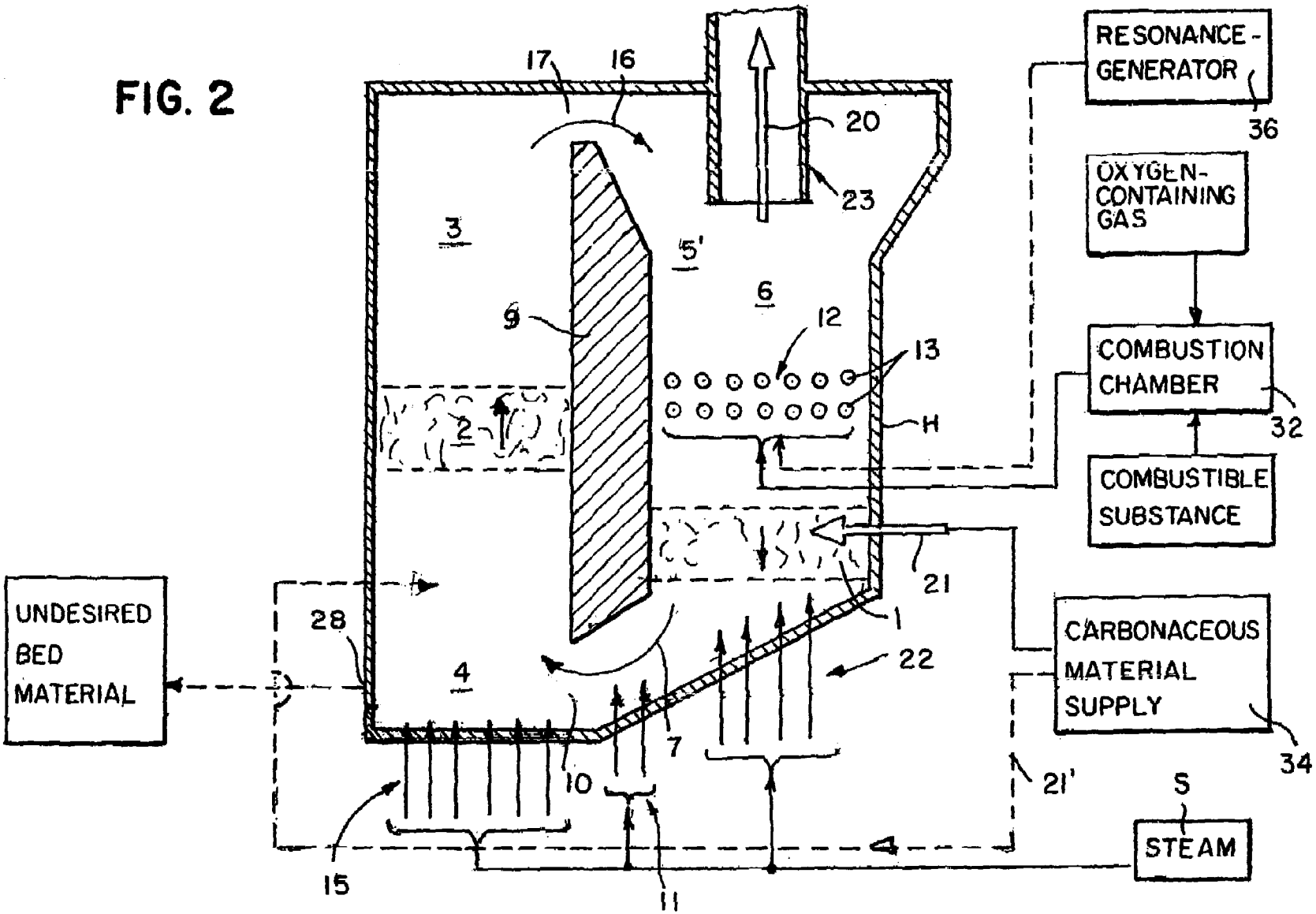
FIG. 2 is a cross section through another embodiment of the apparatus of the invention, where the means for separating the gases from the solid particles is a cyclone.

In the embodiment shown in FIG. 2, the bed material is separated by a cyclone separating and discharging means 5' from the gas flow and fed again via the descending bed 1 to the lower portion of the ascending bed 2. In this instance the gas flow passes via outlet pipe 23 in tangential fashion from the separating and discharging means 5' which is designed as a cyclone.

The invention claimed is:

1. Apparatus for producing combustion gases of high calorific value, comprising:

(a) means defining a vertical heating zone (6) having upper and lower ends;

(b) means defining in said heating zone a descending fluidized bed (1) of non-carbonaceous solid particles;

(c) heating means (8) for indirectly heating said non-carbonaceous, solid particles, said heating means including an external combustion chamber (32) for generating a heat exchanging medium, and tubular members (13) arranged in said solid particle bed and through which said heat exchanging medium is supplied;

(d) means defining a vertical reaction zone (3) having upper and lower ends;

(e) means (34) for supplying carbonaceous material to at least one of said heating and reaction zones;

(f) first transfer passage means (7) for transferring the heated solid particles from the bottom of said heating zone to the bottom of said reaction zone;

(g) first fluidizing means (4) for producing in said reaction zone an upwardly ascending fluidized bed of said heated solid particles, whereby carbonaceous fuel is allothermically gasified in a fluidized layer;

(h) second transfer passage means (16) for transferring the gasified solid particles from the upper end of said reaction zone to a separating and discharging zone (5) arranged above said heating zone; and (i) separating and discharging means (5, 5') arranged in said separating and discharging zone for separating the combustion gases from the gasified solid particles, said separating and discharging means being operable to discharge the combustion gases upwardly from said separating and discharging zone, and to return said non-carbonaceous solid particles to the upper end of said heating zone.

2. Combustion gas producing apparatus as defined in claim 1, wherein said first fluidizing means (4) produces in said reaction zone a fluidized bed (2) that ascends rapidly relative to the descending rate of said solid particle bed (1) in said heating zone.

3. Combustion gas producing apparatus as defined in claim 2, wherein said heating and reaction zones are laterally arranged, and further wherein said first and second transfer passage means are generally horizontal, said separator means being arranged in the upper portion of said heating chamber.

4. Combustion gas producing apparatus as defined in claim 3, and further Including a housing (H) containing a chamber, said housing including a vertical intermediate separating wall (9) dividing said chamber into two chamber portions, said heating zone and said reaction zone being arranged in said chamber portions on opposite sides of said separating wall, respectively.

5. Combustion gas producing apparatus as defined in claim 3, and further including a pair of separate housings having chambers containing said heating zone and said reaction zone, respectively, said first and second transfer passages comprising pipes connected between said housings, respectively.

6. Combustion gas producing apparatus as defined in claim 4, wherein said first transfer passage means comprises an opening (10) contained in said separating wall.

7. Combustion gas producing apparatus as defined in claim 6, wherein said separating wall opening (10) communicates with the lower portion of said heating zone.

8. Combustion gas producing apparatus as defined in claim 7, and further including:

(i) second fluidizing means (22) for directing fluid into said solid particle bed in said heating zone: and (k) third fluidizing means arranged adjacent said first transfer passage means (7) for partially fluidizing the solid particles during the transfer thereof from said heating zone to said reaction zone, said third fluidizing means including a third nozzle bottom (11) for spraying a fluidizing gas into said first transfer passage means.

9. Combustion gas producing apparatus as defined in claim 1, wherein said non-carbonaceous solid particles are selected from the group consisting of quartz sand, limestone, dolomite, corundium, and fuel ash.

10. Combustion gas producing apparatus as defined in claim 1, and further wherein said heat exchanger means includes a resonating combustion chamber (32) supplying a pulsating heating medium to said heat exchanger tubular members.

11. Combustion gas producing apparatus as defined in claim 9, wherein said heat exchanger means includes a resonance generator (36).

12. Combustion gas producing apparatus as defined in claim 1, wherein said first fluidizing means (4) comprises a first nozzle bottom (15) arranged in the bottom of said reaction zone.

13. Combustion gas producing apparatus as defined in claim 3, wherein said separating and discharging moans comprises a cyclone (23), the remaining solid particles being returned to said heating zone.

14. Combustion gas producing apparatus as defined in claim 3, wherein said separating and discharging means (5) comprises baffle means (18,19) for producing multiple deflection of the output gas flow, thereby to return the remaining solid particles to said heating zone.

15. Combustion gas producing apparatus as defined in claim 4, wherein said second transfer passage means (16) comprises an opening (17) contained in said separating wall arranged between said reaction zone and said heating zone.

16. Combustion gas producing apparatus as defined in claim 1, and further including supply means (21) for supplying the carbonaceous material to said heating zone.

17. Combustion gas producing apparatus as defined in claim 1, and further including supply means (21') for supplying the carbonaceous material to said reaction zone.

* * * * *